US010878695B2

(12) United States Patent
Back

(10) Patent No.: US 10,878,695 B2
(45) Date of Patent: Dec. 29, 2020

(54) SYSTEM OF TRAFFIC FORECASTING

(71) Applicant: QUANTUMGATE INC., Sejong-si (KR)

(72) Inventor: Ju-yong Back, Seoul (KR)

(73) Assignee: QUANTUMGATE INC., Sejong-si (KR)

( * ) Notice: Subject to any disclaimer, the term of this patent is extended or adjusted under 35 U.S.C. 154(b) by 0 days.

(21) Appl. No.: 16/611,156

(22) PCT Filed: Mar. 23, 2018

(86) PCT No.: PCT/KR2018/003413
§ 371 (c)(1),
(2) Date: Nov. 5, 2019

(87) PCT Pub. No.: WO2018/212444
PCT Pub. Date: Nov. 22, 2018

(65) Prior Publication Data

US 2020/0082712 A1 Mar. 12, 2020

(30) Foreign Application Priority Data

May 15, 2017 (KR) ..... 10-2017-0059903

(51) Int. Cl.
*G08G 1/00* (2006.01)
*G08G 1/01* (2006.01)

(52) U.S. Cl.
CPC ..... *G08G 1/0129* (2013.01); *G08G 1/0112* (2013.01); *G08G 1/0141* (2013.01)

(58) Field of Classification Search
CPC ... G01G 1/0129; G01G 1/0112; G01G 1/0141
(Continued)

(56) References Cited

U.S. PATENT DOCUMENTS 5,281,964 A * 1/1994 Iida ..... G08G 1/0104 340/933
6,285,949 B1 * 9/2001 Roediger ..... G08G 1/0104 340/934

(Continued)

FOREIGN PATENT DOCUMENTS

JP 11-101647 A 4/1999
JP 11-120478 A 4/1999

(Continued)

*Primary Examiner* — Ojiako K Nwugo
(74) *Attorney, Agent, or Firm* — Novick, Kim & Lee, PLLC; Jae Youn Kim

(57) ABSTRACT

A system for traffic forecasting which calculates a traffic accident incidence within a specific distance from road surface information sensed through a sensor, weather information and traffic information, thereby informing a driver of traffic accident incidence according to the speed and providing the driver with an image corresponding thereto are described. The system includes a sensor part for sensing at least one of a predetermined first information, a communication part for receiving a second information from at least one of weather related organizations and road traffic related organizations, a memory part for saving a plurality of images which are connected with the traffic accident incidence, and a control part for calculating a traffic accident incidence within a specific distance from the system for traffic forecasting using the first and second information.

5 Claims, 13 Drawing Sheets

(58) Field of Classification Search
USPC ..... 340/908
See application file for complete search history.

(56) References Cited

U.S. PATENT DOCUMENTS

| | | | | |
|---|---|---|---|---|
| 6,690,928 | B1 * | 2/2004 | Konishi | H04M 11/002 455/405 |
| 2007/0052530 | A1 * | 3/2007 | Diebold | B60W 30/08 340/467 |
| 2014/0278032 | A1 * | 9/2014 | Scofield | G08G 1/0133 701/118 |
| 2015/0051823 | A1 * | 2/2015 | Joglekar | G08G 1/0145 701/118 |
| 2016/0379486 | A1 * | 12/2016 | Taylor | G08G 1/096844 340/905 |
| 2018/0330611 | A1 * | 11/2018 | Jiang | G08G 1/22 |

FOREIGN PATENT DOCUMENTS

| | | | |
|---|---|---|---|
| KR | 10-2001-0016528 | A | 3/2001 |
| KR | 10-2006-0104374 | A | 10/2006 |
| KR | 10-2016-0095877 | A | 8/2016 |

* cited by examiner

ICY ROAD SURFACE AND ACCIDENT RATE

| EVENT TYPE | N | RELATIVE RISK OF | |
|---|---|---|---|
| | | COLLLSION | INJURY |
| RAIN < 10 mm | 706 | 1.56 | 1.41 |
| RAIN ≥ 10 mm | 138 | 1.86 | 1.28 |
| MIXED RAIN & SNOW | 126 | 1.71 | 1.38 |
| REDUCED VISIBILITY + MEASUREABLE SNOWBALL | 12 | 2.42 | 2.26 |
| SNOWFALL ≥ 3Cm | 35 | 2.42 | 2.26 |
| SNOWFALL < 3Cm | 122 | 2.42 | 2.26 |
| FIRST SNOWFALLS | 34 | 2.42 | 2.26 |

[ TIME AND ACCIDENT RATE ]

| ANALYSIS FACTORS | THE MOST FREQUENT VARIABLES | SHARES |
|---|---|---|
| BY TIME | 4 TO 8 P.M. | 24.9% |
| BY DAY | FRIDAY | 24.9% |
| BY MONTH | AUTUMN (SEPTEMBER TO NOVEMBER) | 24.9% |

RECORDS OF TRAFFIC ACCIDENTS BY TIME FOR 2015
(THE ROAD TRAFFIC AUTHORITY)

THE NUMBER OF ACCIDENTS BY TIME(2007)[1]

RECORD OF TRAFFIC ACCIDENTS BY AREA FOR 2015
(THE ROAD TRAFFIC AUTHORITY)

TRAFFIC ACCIDENT RATE AND ACCIDENT DANGER
DEGREE ON THE SPECIFIC ROAD [2]

CIRCUMSTANCE SETTINGS ASSUMING THAT VEHICLE A PASSES A SPECIFIC POSITION, OO
WEATHER CONDITION : SNOWFALL IS 10mm
PAST ACCIDENT HISTORY : ONCE A YEAR
STATE OF ROAD SURFACE : DANGEROUS DUE TO ICY RDAD
SPEED OF VEHICLE A : 10km/h HIGHER THAN ROAD SPEED LIMIT

| DANGER DEGREE OF VEHICLE A PASSING OO, BY ACCIDENT INCIDENDCE FACTOR | | | |
|---|---|---|---|
| WEATHER INFORMATION | PAST ACCIDENT HISTORY | STATE OF ROAD SURFACE | SPEED OF VEHICLE |
| 70/100 | 30/100 | 80/100 | 50/100 |

| SCHOOL ZONE | | | | |
|---|---|---|---|---|
| FACTOR | DANGER DEGREE | WEIGHT | DANGER DEGREE ×WEIGHT | FINAL DANGER DEGREE |
| WEATHER INFORMATION | 70 | 0.1 | 7 | 51/100 (7+6+8+30) |
| ACCIDENT SURFACE | 30 | 0.2 | 6 | |
| ROAD SURFACE | 80 | 0.1 | 8 | |
| SPEED | 50 | 0.6 | 30 | |

| SILVER ZONE | | | | |
|---|---|---|---|---|
| FACTOR | DANGER DEGREE | WEIGHT | DANGER DEGREE ×WEIGHT | FINAL DANGER DEGREE |
| WEATHER INFORMATION | 70 | 0.1 | 7 | 51/100 (7+6+8+30) |
| ACCIDENT SURFACE | 30 | 0.2 | 6 | |
| ROAD SURFACE | 80 | 0.1 | 8 | |
| SPEED | 50 | 0.6 | 30 | |

| DANGER ZONE (WHERE ACCIDENTS ARE FREQUENTLY OCCURRED DUE TO ROAD STRUCTURE) | | | | |
|---|---|---|---|---|
| FACTOR | DANGER DEGREE | WEIGHT | DANGER DEGREE ×WEIGHT | FINAL DANGER DEGREE |
| WEATHER INFORMATION | 70 | 0.1 | 7 | 51/100 (7+6+8+30) |
| ACCIDENT SURFACE | 30 | 0.2 | 6 | |
| ROAD SURFACE | 80 | 0.1 | 8 | |
| SPEED | 50 | 0.6 | 30 | |

FIG.8

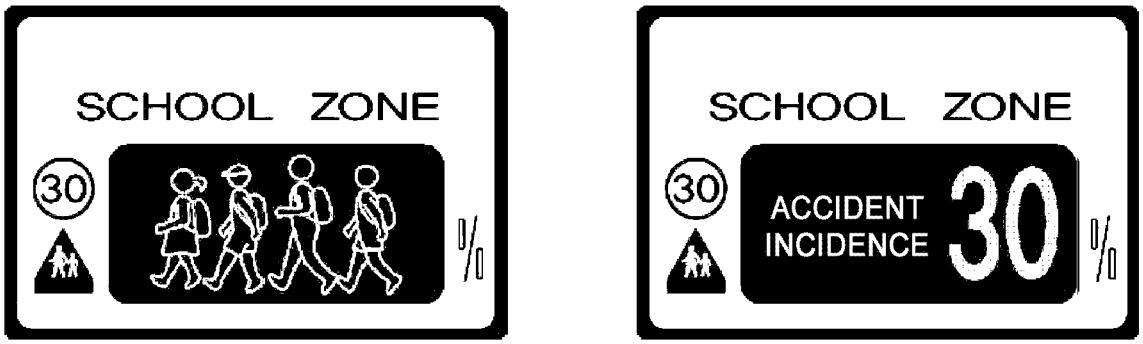
FIG. 9A-(A)
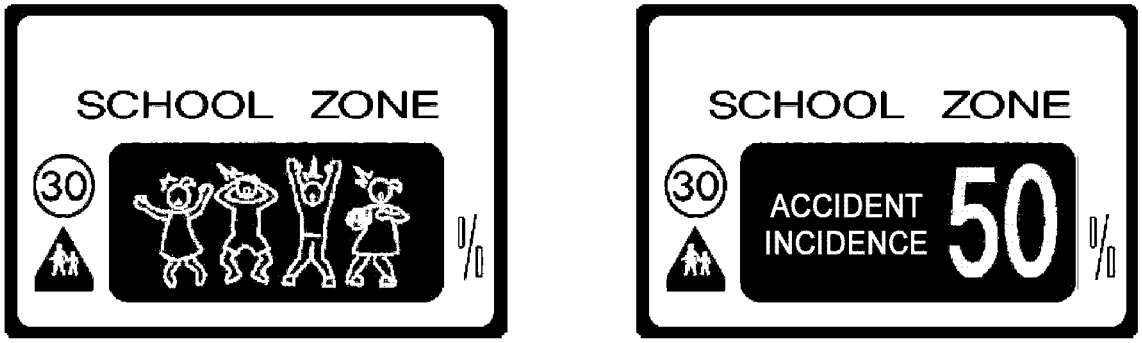
FIG. 9A-(B)
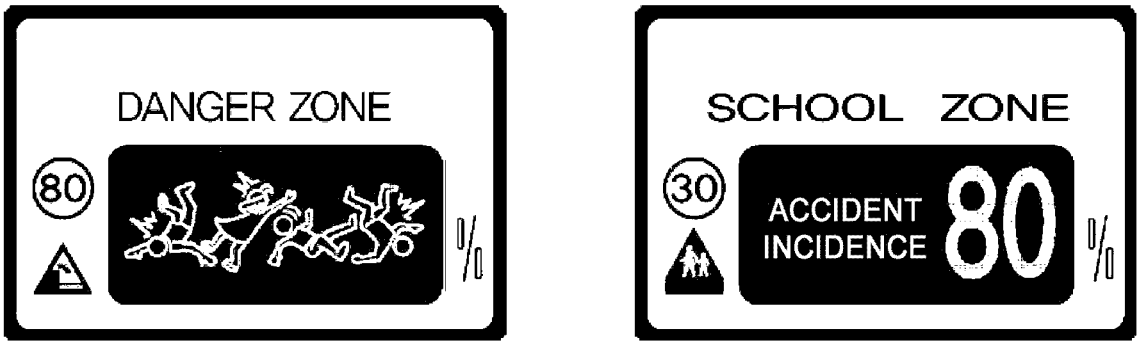
FIG. 9A-(C)

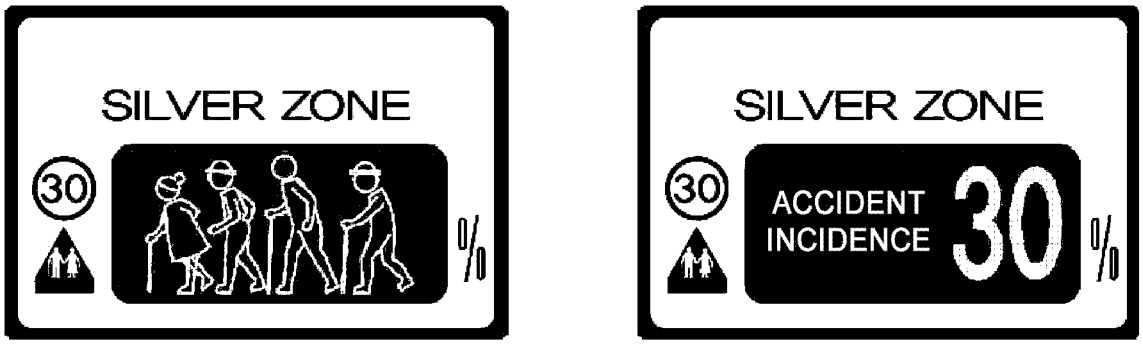
FIG. 9B-(A)
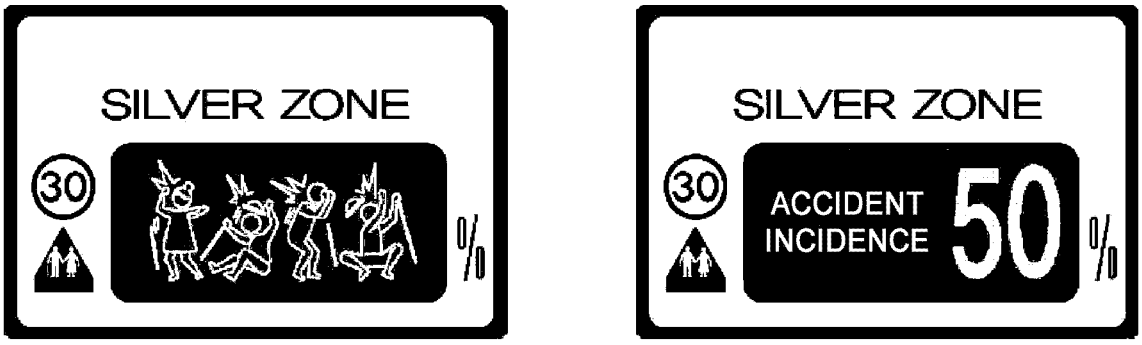
FIG. 9B-(B)
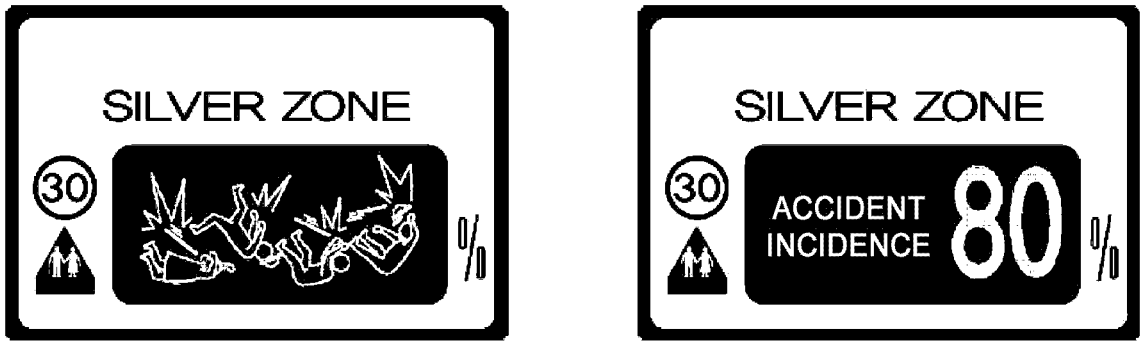
FIG. 9B-(C)

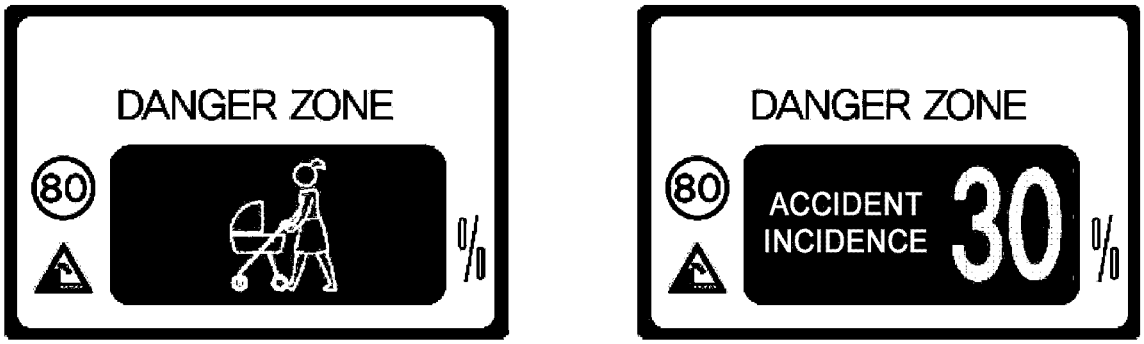
FIG. 9C-(A)
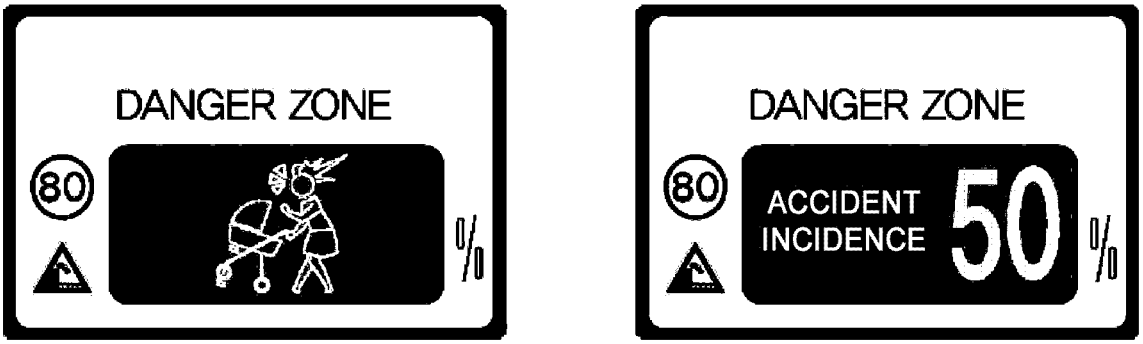
FIG. 9C-(B)
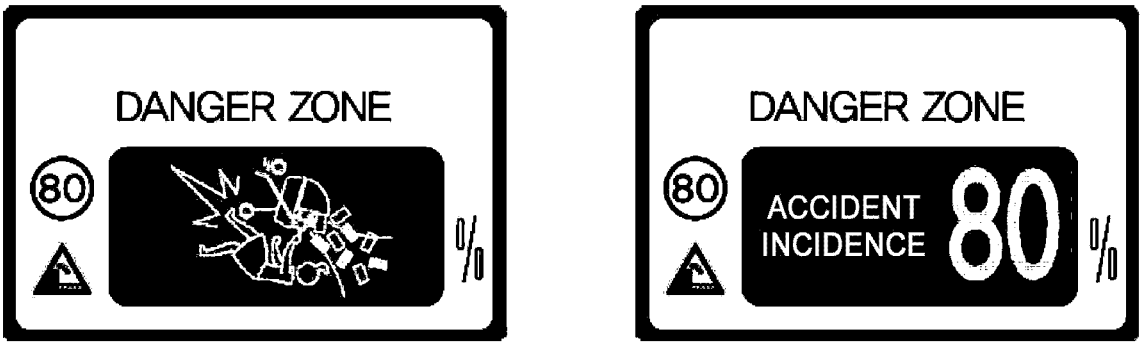
FIG. 9C-(C)

SYSTEM OF TRAFFIC FORECASTING

TECHNICAL FIELD

The present invention relates to a system of traffic forecasting. In particular, the system of traffic forecasting which calculates a traffic accident incidence within a specific distance from road surface information sensed through a sensor, weather information and traffic information, thereby informing a driver of the traffic accident incidence according to the speed and providing the driver with an image corresponding thereto.

BACKGROUND ART

As the number of vehicles has been increased in recent years, the quality of our life is improved and it is possible for us to possess life convenience and enjoy various leisure activities. Accordingly vehicle driving becomes more frequent and the number thereof is increased. Consequently safety accident incidence is increased gradually.

In general, road traffic information is important for a vehicle user. In particular, the road surface information helps not only a vehicle user driving safely but also a road manager performing maintenance of the icy road immediately.

In particular, the icy road due to either snow or rain in the winter season is one of major reasons for the traffic accident. Thus, the state of the icy road should be detected and requires an immediate and appropriate maintenance so as to prevent road causalities in advance.

It cannot be deniable that a vehicle, as a transportation, is advantageous and beneficial for human life. However, as described above, traffic accident due to a vehicle is increased every year. In generally, used are two methods using a sensor laid under the road and either codeless camera or CCTV installed at the critical point on the road for managing either the volume of traffic or thereof. A loop detector which is laid under the road is currently used as a vehicle detector.

As described above, in the case of conventional roads and bridges, since hardly could the icy state thereof be recognized in advance, it is difficult for a road manager to perform immediate maintenance and traffic accident due to the icy road could not be minimized. That is, since the road manager visits a road site and checks the state thereof followed by either installing a signboard or clearing snow from the road, it is difficult to check the icy state of each road site at the same time. Thus, the establishment of countermeasure may be delayed. Meanwhile, as a conventional method for checking a road state without visiting a road site, is used a method for monitoring the state of road surface using emitting either a microwave or an infrared ray. This method is reliable but it has a broad range of results. Further, each of water and ice has different reflexibility and hardly can they be applied thereto when one of them is present on the road surface. Thus, it has a poor accuracy.

Further, it is insufficient to install conventional road forecasting systems in the areas, such as school zones, silver zones, danger zones and etc., where the traffic accident incidence is high, most drivers keep driving in these areas even during a period of vehicle driving restriction time, and it is frequently occurred to violate not only traffic signal but also speed limits. Further, pedestrians such as children, the elderly and etc., frequently cross at a crosswalk carelessly.

There is, thus, a drawback that the possibility of an accident due to a running vehicle will be increased.

DISCLOSURE

Technical Problem

The present invention is directed to providing a system of traffic forecasting which calculates a traffic accident incidence within a specific distance from road surface information sensed through a sensor, weather information and traffic information, informs a driver of the traffic accident incidence according to the speed and provides the driver with an image corresponding thereto, thereby solving problems and drawbacks as described above.

To achieve in the present invention are not limited to the technical problem mentioned above, in another aspect not covered will be clearly understood to those of ordinary skilled in the art from the following description.

Technical Solution

In an aspect of the present invention, a system of traffic forecasting may include a sensor part for sensing at least one of predetermined first information; a communication part for receiving a second information from at least one of weather related organizations and road traffic related organizations; a memory part for saving a plurality of images which are connected with the traffic accident incidence; a control part for calculating a traffic accident incidence within a specific distance from the system for traffic forecasting using the first and second information, and for determining an image corresponding to the traffic accident incidence from the plurality of images; and a display part for displaying the traffic accident incidence and the image according to the control of the control part.

According to an exemplary embodiment of the present invention, the first information may include weather information, road state information and vehicle speed information.

According to the exemplary embodiment of the present invention, the second information may include accident history information, weather information, road state information, place information and date information.

According to the exemplary embodiment of the present invention, the plurality of images may include a first image which announces a general state under a predetermined first reference and; a second image which announces a slightly dangerous state between the first reference and a predetermined second reference and; and a third image which announces a dangerous state over the second reference.

According to the exemplary embodiment of the present invention, the control part may calculate a dew point temperature using a relative humidity included in the first information and an ambient temperature included in the second information, and may then calculate a traffic accident incidence using the dew point temperature.

According to the exemplary embodiment of the present invention, the dew point temperature may be calculated by the formula 1 represented as below, $$D_p(T, RH) = \frac{\lambda \times \left[\ln\left(\frac{RH}{100}\right) + \frac{\beta \times T}{\lambda + T}\right]}{\beta - \left[\ln\left(\frac{RH}{100}\right) + \frac{\beta \times T}{\lambda + T}\right]} \quad \text{[Formula 1]}$$

where Dp is a dew point temperature, T is an ambient temperature, RH is a relative humidity and ββ and λλ represent, as a Magnus constant, 17.62 and 243.12° C.° C., respectively.

According to the exemplary embodiment of the present invention, the communication part may share the traffic accident incidence and the image with peripheral devices.

According to the exemplary embodiment of the present invention, the communication part may share the traffic accident incidence and the image with peripheral devices.

According to the present invention, the system of traffic forecasting is capable of calculating a traffic accident incidence within a specific distance from road surface information sensed through a sensor, weather information and traffic information, informing a driver of the traffic accident incidence according to the speed and providing the driver with an image corresponding thereto. Therefore, it arouses a driver's attention and is capable of immediately taking action against unexpected situations from various transmitted information and managing risk factors of the road.

Further, the present invention may be installed in the areas, such as school zones, silver zones, danger zones and etc., where the traffic accident incidence is high, thereby reducing accidents which induce road causalities. Further, each of images corresponding to the area and the traffic accident incidence respectively may be displayed on a signboard. Alternatively, the traffic accident incidence may be displayed thereon. Thus, a driver is capable of directly recognizing the image and the traffic accident occurrence, thereby feeling the degree of danger.

Meanwhile, effects of the present invention are not limited to the above mentioned effects, in another aspect not covered will be clearly understood to those of ordinary skilled in the art from the following description.

DESCRIPTION OF DRAWINGS

FIG. 8 is a diagram where a weight is applied to the traffic accident incidence calculated in the control part.

FIG. 9A-(A) to FIG. 9C-(C) are diagrams illustrating the traffic accident incidence displayed on a display part and the image according thereto.

BEST MODE

Figure 1:
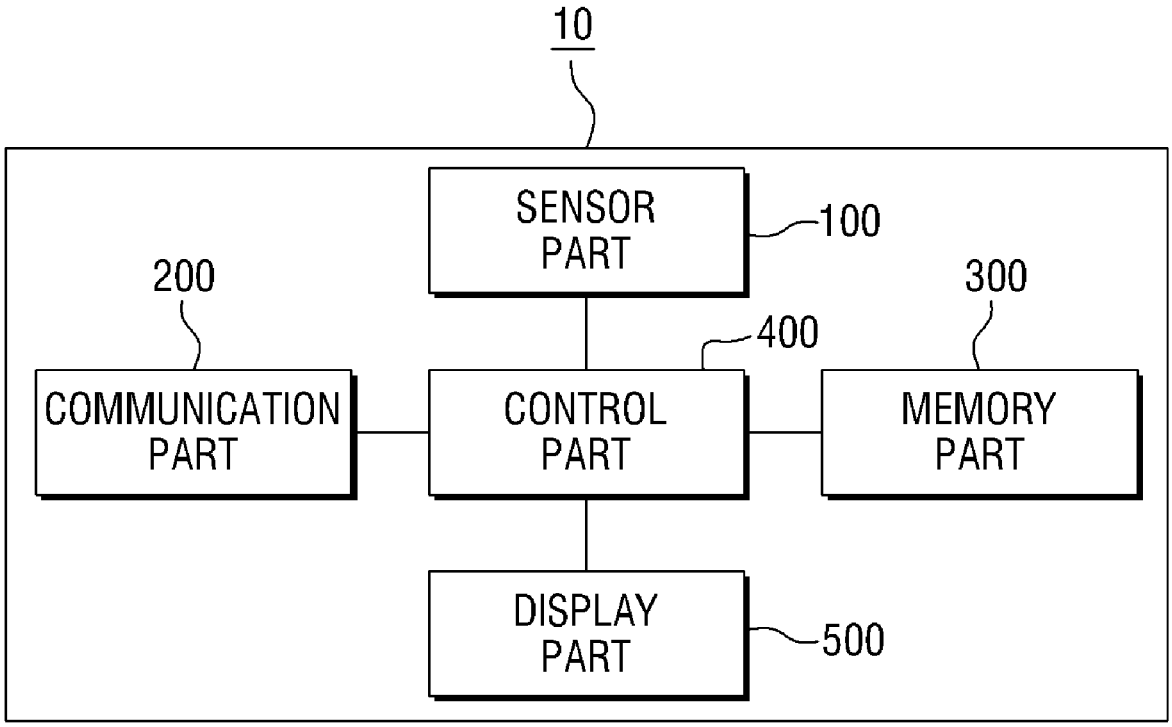
FIG. 1 shows a system of traffic forecasting according to an exemplary embodiment of the present invention.

Exemplary embodiments of the present invention will now be described with reference to the accompanying drawings so that this description will be through and complete, and will fully convey the exemplary embodiments of the present invention to those of ordinary skilled in the art. However, since the description of the present invention is nothing more than the exemplary embodiments which describe the present invention configurationally and functionally, the scope thereof is not limited to the exemplary embodiments described herein. That is, the exemplary embodiments can be modified variously and have different forms, and thus the scope of the present invention may include equivalents which are capable of implementing the technical idea thereof. Further, never do the objects or effects presented herein mean that a particular exemplary embodiment includes either these of all or these effects only. Thus, the scope of the present invention may not be limited thereto.

Terms used in the present invention may be understood as followings.

The terms such as 'first', 'second' and etc., are used for distinguishing one element from the others, and thus never may the scope of the present invention be limited thereto. For example, a first element can be named as a second element, and similarly therewith, a second element also can be named as a first element. When mentioning that a certain element is connected to other elements, it may be not only directly connected thereto but there may be also possibly another element therebetween. On the other hand, when mentioning that a certain element is directly connected to other elements, there is no further element therebetween. Meanwhile, other terms describing the relationship between elements, such as "between ~" and "directly between ~", and/or "adjacent to ~" and "directly adjacent to ~" and etc., may be interpreted like the preceding.

The expressions in a singular form may include a plural form thereof unless they are obviously different from each other in the context. Further, the terms such as "comprise", "include" and etc., are intended to designate the presence of features, numbers, steps, operations, elements, components or the combination thereof, and they may not exclude the presence or addition of one or more different features, numbers, steps, operations, elements, components or the combination thereof, in advance.

All of the terms used herein have the same meanings as what are generally understood by those skilled in the art, unless they are defined differently. The generally used terms which are defined in the dictionary may be interpreted as meanings conforming to those of the related art in the context, and they may be not interpreted either ideally or excessively formally unless being defined clearly in the present invention.

In the case of conventional roads and bridges, since hardly could the icy state thereof be recognized in advance, it is difficult for a road manager to perform immediate maintenance and traffic accident due to the icy road could not be minimized.

Further, it is insufficient to install conventional road forecasting systems in the areas where the traffic accident incidence is high, such as school zones, silver zones, danger zones and etc., most drivers keep driving in these areas even during a period of vehicle driving restriction time, and it is frequently occurred to violate not only traffic signal but also speed limits. Accordingly, pedestrians such as children, the elderly and etc., frequently cross at a crosswalk carelessly, there is a drawback that the possibility of an accident due to a running vehicle would be increased.

Accordingly, the present invention provides a system of traffic forecasting to resolve the above descried drawbacks.

According to the present invention, the system of traffic forecasting can calculate a traffic accident incidence within a specific distance from road surface information sensed through a sensor, weather information and traffic information, thereby informing a driver of the traffic accident incidence according to the speed and providing the driver with an image corresponding thereto.

Figure 2:
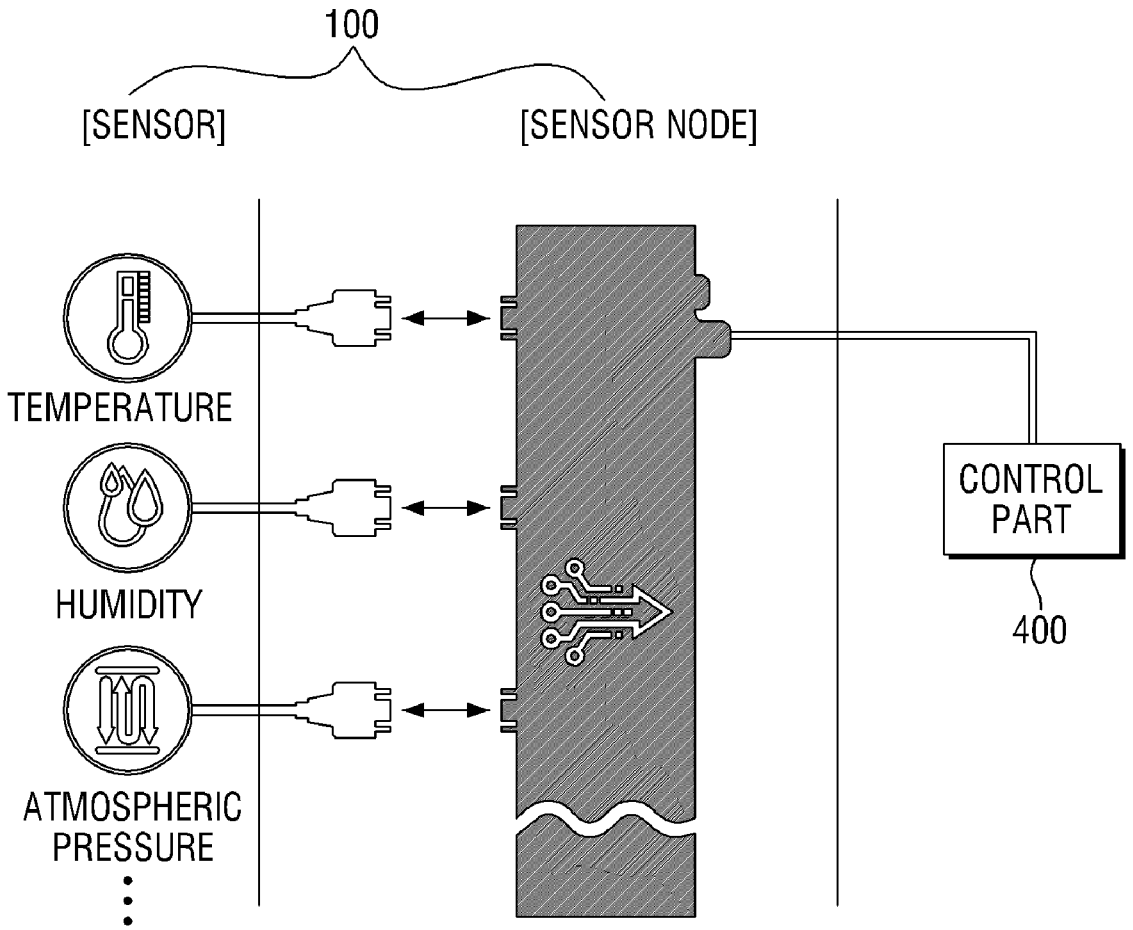
FIG. 2 shows a sensor part.

FIG. 1 shows a system of traffic forecasting according to an exemplary embodiment of the present invention, and FIG. 2 shows a sensor part illustrated in FIG. 1.

Referring to FIG. 1, the system of traffic forecasting 10 may include a sensor part 100, a communication part 200, a memory part 300, a control part 400 and a display part 500.

The sensor part 100 senses at least one piece of predetermined first information and transfers the sensed first information to the control part 400.

According to an exemplary embodiment of the present invention, the first information may be concerned with weather information (preferably, temperature, humidity, atmospheric pressure and etc.), road state information and vehicle speed information.

According to the exemplary embodiment of the present invention, the sensor part 100 may sense temperature, humidity and atmospheric pressure of the road surface or the atmosphere, a road state and etc.

According to the exemplary embodiment of the present invention, the sensor part 100 may include a sensor node (See FIG. 2), thereby transferring the first information to the sensor node, and the sensor node is, thus, capable of transferring the received first information to the control part 400.

According to the exemplary embodiment of the present invention, the sensor node may merge several pieces of the first information sensed in the sensor part 100 into one, followed by encoding it.

According to the exemplary embodiment of the present invention, the communication part 200 may receive a second information from at least one of weather related organizations and road traffic related organizations, thereby transferring the received second information to the control part 400.

According to the exemplary embodiment of the present invention, the communication part 200 may share the traffic accident incidence and the image with peripheral devices, thereby sharing the traffic accident incidence and the image with organizations such as government organizations, enterprises, laboratories and etc.

According to the exemplary embodiment of the present invention, the second information may include accident history information, weather information, road state information, place information and date information received from the organizations (that is, weather or road traffic related organizations).

According to the exemplary embodiment of the present invention, the weather information may include weather, atmospheric temperature, rainfall and etc.

The memory part 300 saves a plurality of images which are connected with the traffic accident incidence.

According to the exemplary embodiment of the present invention, the memory part 300 may save a plurality of videos which are connected with the traffic accident incidence.

According to the exemplary embodiment of the present invention, the memory part 300 may transfer images determined in the control part 400 to the control part 400.

According to the exemplary embodiment of the present invention, the memory part 300 may save each of images corresponding to school zones, silver zones, danger zones and etc., respectively.

According to the exemplary embodiment of the present invention, the memory part 300, for example, may save images where a child is walking, astonished or falls down and then gets injured, according to the vehicle accident rate corresponding the school zones (See FIG. 9A).

According to the exemplary embodiment of the present invention, the memory part 300, for example, may save images where the elderly holding a cane is walking, astonished or falls down and then gets injured according to the vehicle accident rate corresponding the silver zones (See FIG. 9B).

According to the exemplary embodiment of the present invention, the memory part 300, for example, may save images where a person carrying a stroller is walking, astonished or falls down and then gets injured according to the vehicle accident rate corresponding the danger zones (See FIG. 9C).

According to the exemplary embodiment of the present invention, the memory part 300 may further save a plurality of danger indexes connected with the traffic accident incidence (that is, traffic safety indexes for announcing traffic accident danger degrees according to vehicle speeds to a vehicle driver).

According to the exemplary embodiment of the present invention, the memory part 300 may save a plurality of danger indexes which are connected with the traffic accident incidence (or, a plurality of images).

According to the exemplary embodiment, the danger indexes may be traffic safety indexes for announcing the danger degree of traffic accidents.

The control part 400 calculates a traffic accident incidence within a specific distance from the system for traffic forecasting 10 using the first and second information transferred from the sensor part 100 and the communication part 200, respectively, and determines an image corresponding to the traffic accident incidence from the plurality of the images.

According to the exemplary embodiment of the present invention, the control part 400 may an image corresponding to the calculated traffic accident incidence, thereby receiving the determined image from the memory part 300.

According to the exemplary embodiment of the present invention, the control part 400 may determine the traffic accident incidence and the image corresponding thereto and then transfer the relevant determined traffic accident incidence and image to the display part 500.

According to the exemplary embodiment of the present invention, the control part 400 may impose a weight on the area, such as school zones, silver zones, danger zones and etc., which shows a high traffic accident incidence so as to calculate a final danger degree, and it may also receive the determined image from the memory part 300, wherein the final danger degree is capable of being calculated by multiplying the traffic accident incidence by the weight and the control part 400 is capable of resaving the relevant final danger degree as the traffic accident incidence.

According to the exemplary embodiment of the present invention, the control part 400 may calculate a traffic accident incidence using weather information, accident history information, road surface information and vehicle speed information included in the first and second information.

According to the exemplary embodiment of the present invention, the plurality of images may include first, second and third images.

The first image announces a general state under a predetermined first reference.

According to the exemplary embodiment of the present invention, the first image may announce the general state where people are walking.

The second image announces a slightly dangerous state between the first reference and a predetermined second reference.

According to the present invention, the second image may announce the slightly dangerous state where people are astonished or fall down due thereto.

The third image announces a dangerous state over the second reference.

According to the exemplary embodiment of the present invention, the third image may announce the dangerous state where people fall down and then get injured.

According to the exemplary embodiment of the present invention, the first and second images may be, as a predetermined traffic accident incidence, changed according to the use thereof.

According to the exemplary embodiment of the present invention, the first reference may be, for example, determined to be 30% of a traffic accident incidence, wherein the second reference may be determined to be 80% of a traffic accident incidence.

According to the exemplary embodiment of the present invention, the control part 400 may determine a danger index corresponding to the traffic accident incidence (or, the plurality of images) among a plurality of danger indexes.

According to the exemplary embodiment of the present invention, the control part 400 may determine a danger index corresponding to the calculated traffic accident incidence (or, the plurality of images) so as to receive the determined danger index from the memory part 300.

According to the exemplary embodiment of the present invention, the control part 400 may determine a danger index corresponding to the calculated traffic accident incidence (or, the plurality of images) so as to transfer the relevant determined danger index to the display part 500.

According to the exemplary embodiment of the present invention, the plurality of danger indexes may include first, second and third danger indexes.

According to the exemplary embodiment of the present invention, the first danger index may announce a general state under a predetermined first reference. Preferably, the first danger index may announce, as a 'warning' level, announce the general state where a driver should be aware of vehicle speeds (that is, driver's running speeds).

According to the exemplary embodiment of the present invention, the second danger index may announce a slightly dangerous state between the first danger index and a predetermined second danger index. Preferably, the second danger index may announce, as a 'caution' level, the slightly danger state where the driver should be cautioned about vehicle speeds.

According to the exemplary embodiment of the present invention, the third danger index may announce a danger state higher the second danger index. Preferably, the third danger index may announce, as a 'danger' level, the danger state connected with the vehicle speed to the driver.

The display part 500 displays the traffic accident incidence and the image according to the control of the control part 400.

According to the exemplary embodiment of the present invention, the display part 500 may include a light panel (for example, an LED light panel) for displaying the traffic accident incidence and the image.

According to the exemplary embodiment of the present invention, the display part 500 may display the traffic accident incidence (or the image) and the danger indexe.

The system of traffic forecasting 10 including elements as described above, may calculate a traffic accident incidence within a specific distance from road surface information sensed through the sensor, weather information and traffic information, thereby informing a driver of the traffic accident incidence according to the speed and providing the driver with an image corresponding thereto. Therefore, it arouses a driver's attention, is capable of immediately taking action against unexpected situations from various transmitted information, and manages risk factors.

The system of traffic forecasting 10 including elements as described above, may be installed in the areas, such as school zones, silver zones, danger zones and etc., where the traffic accident incidence is high, thereby reducing accidents which induce road causalities. Further, the display part 500 may display each of images corresponding to the areas and the traffic accident incidence respectively. Alternatively, it may display the traffic accident incidence, and thus a driver is capable of directly recognizing the image and the traffic accident incidence, thereby feeling danger degrees.

Operation of the System of Traffic Forecasting According to the Exemplary Embodiment of the Present Invention The control part 400 may calculate a traffic accident incidence within a specific distance from the system for traffic forecasting 10 using the first information transferred from the sensor part 100 and the second information transferred from the communication part 200, followed by transferring the calculated traffic accident incidence to the memory part 300. The memory part 300 may save the relevant transferred traffic accident incidence and transfer the image corresponding to the pre-saved traffic accident incidence to the control part 400. The control part 400 may transfer the relevant transferred image and the calculated traffic accident incidence to the display part 500. The display part 500 may display the relevant transferred image and the traffic accident incidence on the light panel, thereby showing a driver the traffic accident incidence according to the driver's running speed and the image corresponding thereto in the area where the system of traffic forecasting 10 is installed. Therefore, the system of traffic forecasting 10 may arouse a driver's attention to the images (or, videos, animations and danger indexes) according to the vehicle running speed.

Figure 3:
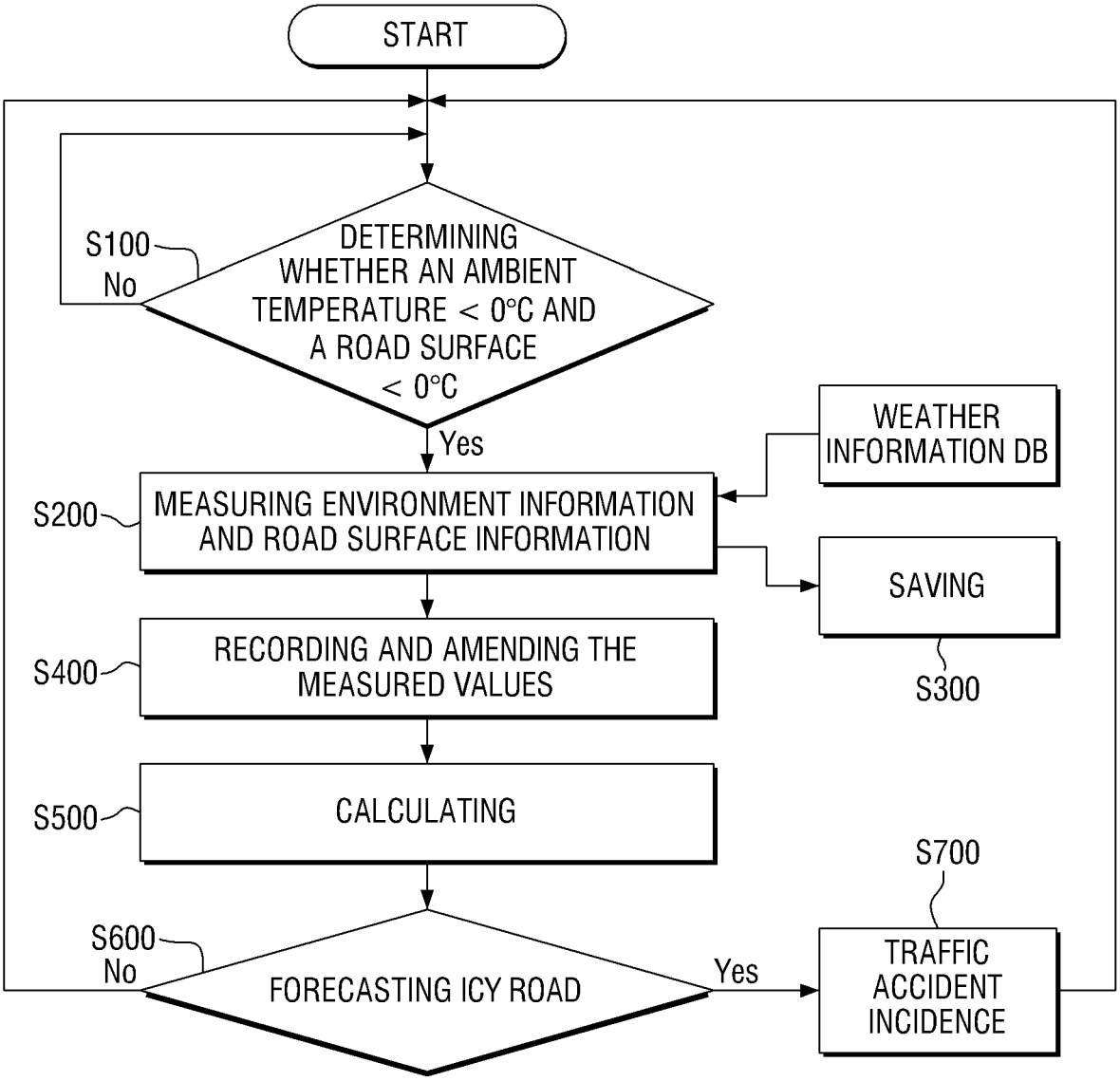
FIG. 3 is a flow chart illustrating a control part where the icy state of the road surface is forecasted and then reflected to a traffic accident incidence.

FIG. 3 is a flowchart of the control part where the icy state of the road surface is forecasted and then reflected to the traffic accident incidence.

Referring to FIG. 3, the sensor part 100 may sense a road surface temperature and an ambient temperature and determine whether the road surface temperature is above zero and the ambient temperature is below zero (S100), and if the road surface temperature is above zero and the ambient temperature is below zero, the sensor part 100 may measure environment information (for example, humidity and atmospheric pressure) and road surface information, and the communication part 200 may transfer weather information (S200).

The control part 400 may receive the sensed information (that is, environment information and road surface information) and weather information from the sensor part 100 and the communication part 200, respectively, followed by storing them in the memory part 300 (S300) and recording and amending the measurement values (S400).

The control part 400 may calculate recorded and amended measurement values (S500), followed by forecasting the icy state of the road surface (S600). If the icy state thereof is forecasted, it is reflected to the traffic accident incidence.

Figure 4:
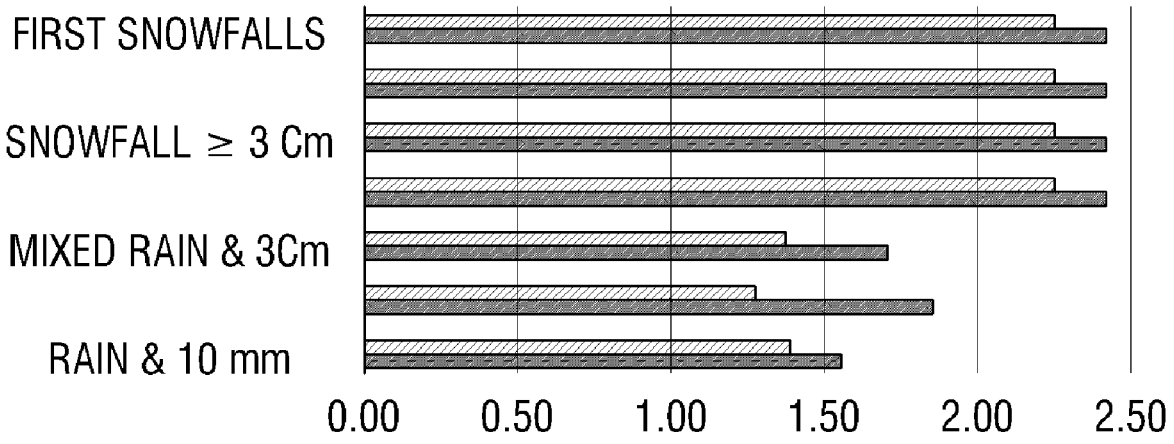
FIG. 4 shows an accident rate according to road surface information in the control part.

FIG. 4 shows the accident rate according to road surface information in the control part.

Referring to FIG. 4, the control part 400 may calculate a dew point temperature using a humidity included in the first information and an ambient temperature included in the second information, and then calculate a traffic accident incidence using the dew point temperature. In other words, the control part 400 may use the dew point temperature so as to calculate a traffic accident incidence for the road surface information, wherein the dew point temperature can be calculated by the formula 1

$$D_p(T, RH) = \frac{\lambda \times \left[\ln\left(\frac{RH}{100}\right) + \frac{\beta \times T}{\lambda + T}\right]}{\beta - \left[\ln\left(\frac{RH}{100}\right) + \frac{\beta \times T}{\lambda + T}\right]} \quad \text{[Formula 1]}$$

where Dp is a dew point temperature, T is an ambient temperature, RH is a relative humidity and ββ and λλ represent, as a Magnus constant, 17.62 and 243.12° C.° C., respectively.

According to the exemplary embodiment of the present invention, the control part 400 may determine whether the road surface is in the icy state by comparing the dew point temperature and the road surface temperature, and calculate a traffic accident incidence for the road surface information using the calculated dew point temperature.

According to the exemplary embodiment of the present invention, the control part 400 may calculate a braking distance from the formula 2, thereby calculating a traffic accident incidence (that is, traffic accident rate according the icy road surface) for the road surface.

$$d = \frac{V^2}{254(f \pm s/100)} \quad \text{[Formula 2]}$$

where, d is a braking distance (m), v is a vehicle running speed, f is a friction coefficient between the tire and the road surface, and s is a longitudinal incline (%).

Figure 5:
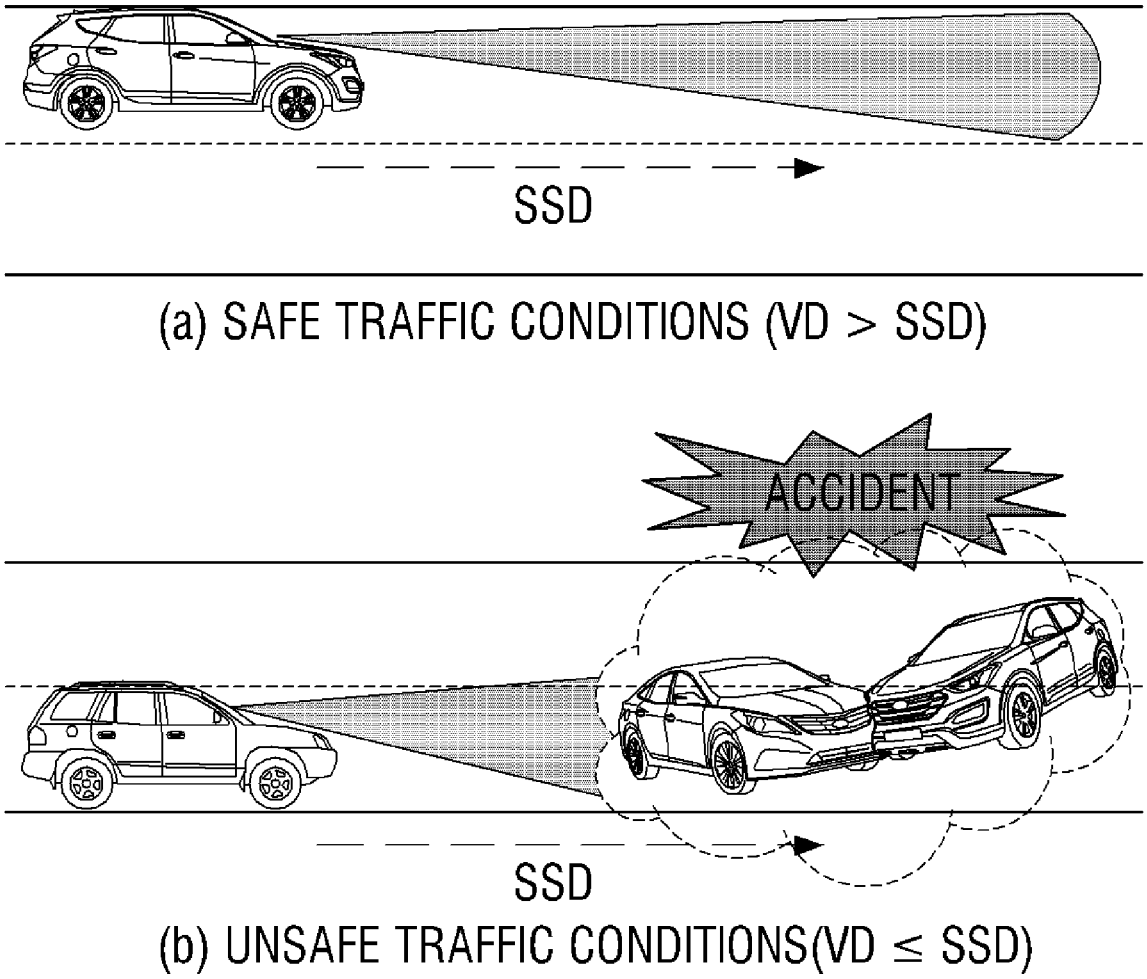
FIG. 5 shows an accident rate according to the weather.

FIG. 5 shows the accident rate according to the weather.

Referring to FIG. 5, a visibility distance according to weather conditions, such as rainfall, snowfall, fog and etc., may be calculated using the formula 3 represented as below and a stopping sight distance may be calculated using the formula 4 represented as below, thereby calculating an accident rate according to the accident history information.

$$SSD = 0.27\ V \times t_r + \frac{V^2}{254(f + s)} \quad \text{[Formula 3]}$$

where, SSD is a stopping sight distance (m), V is a velocity (Km/h), tr is a time for recognition response (sec), f is a tire-road surface friction coefficient, and s is an incline (m/m, uphill (+) and downhill (−)).

$$VD = \frac{3.912}{b_{scat} + b_{abs}} \quad \text{[Formula 4]}$$

where, VD is a visibility distance, b↓↓scat is a scattering coefficient and b↓↓abs is a absorption coefficient.

According to the exemplary embodiment of the present invention, in the control part 400, the visibility distance (VD) may calculate a stopping sight distance (SSD). Thus, it may be determined that when the visibility distance (VD) is greater than the stopping sight distance (SSD), safe driving is possible at a current vehicle speed, while when the visibility distance (VD) is smaller than the stopping sight distance (SSD), safe driving is impossible thereat.

According to the exemplary embodiment of the present invention, in the control part 400, the visibility distance (VD) may calculate an accident rate according to weather information (that is, the accident rate according to the weather condition) using the stopping sight distance (SSD). Thus, the driver can recognize an unexpected situation and respond thereto, thereby tacking action immediately thereagainst.

Figure 6A:
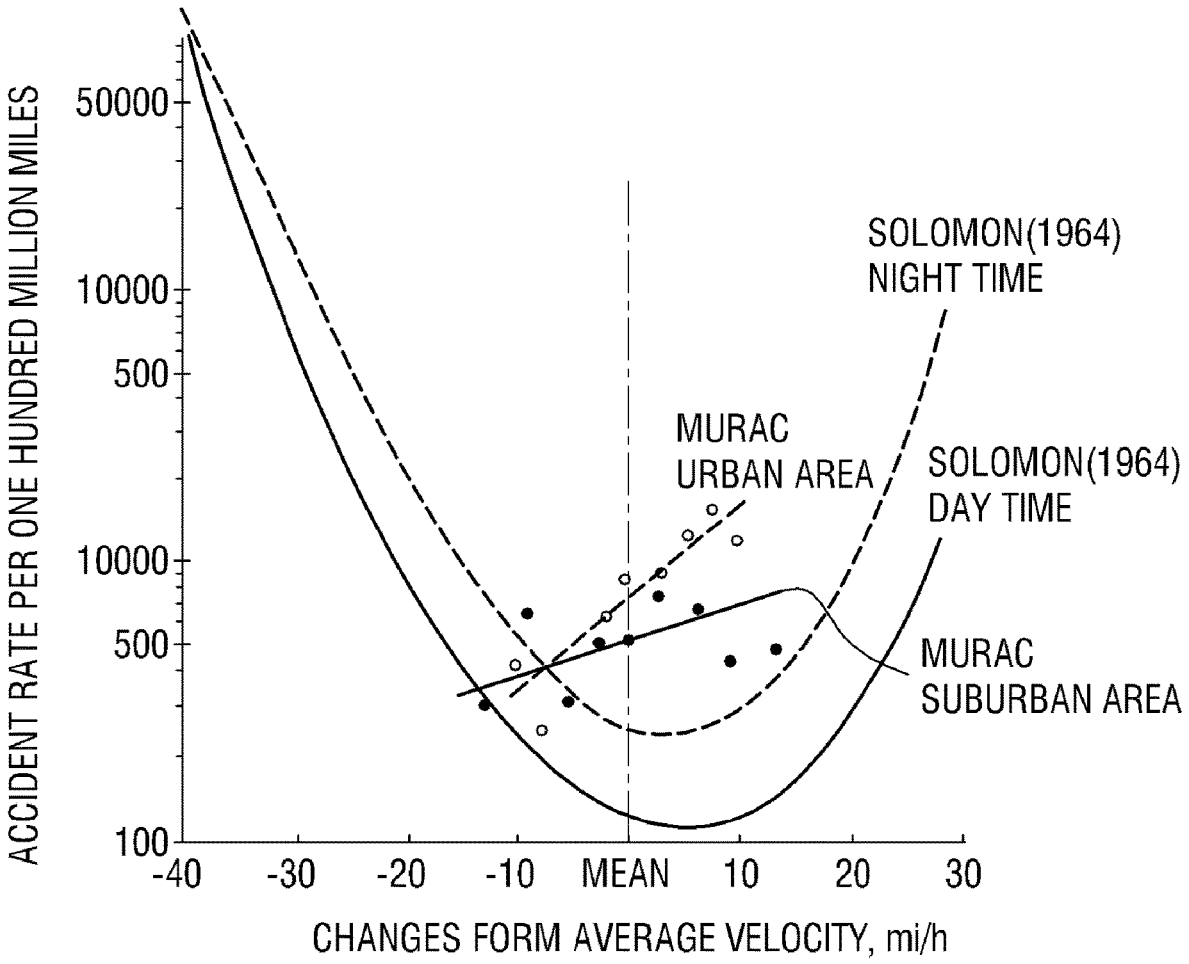
FIGS. 6A and 6B are diagrams explaining an accident rate according to vehicle speed information of the control part.
Figure 6B:
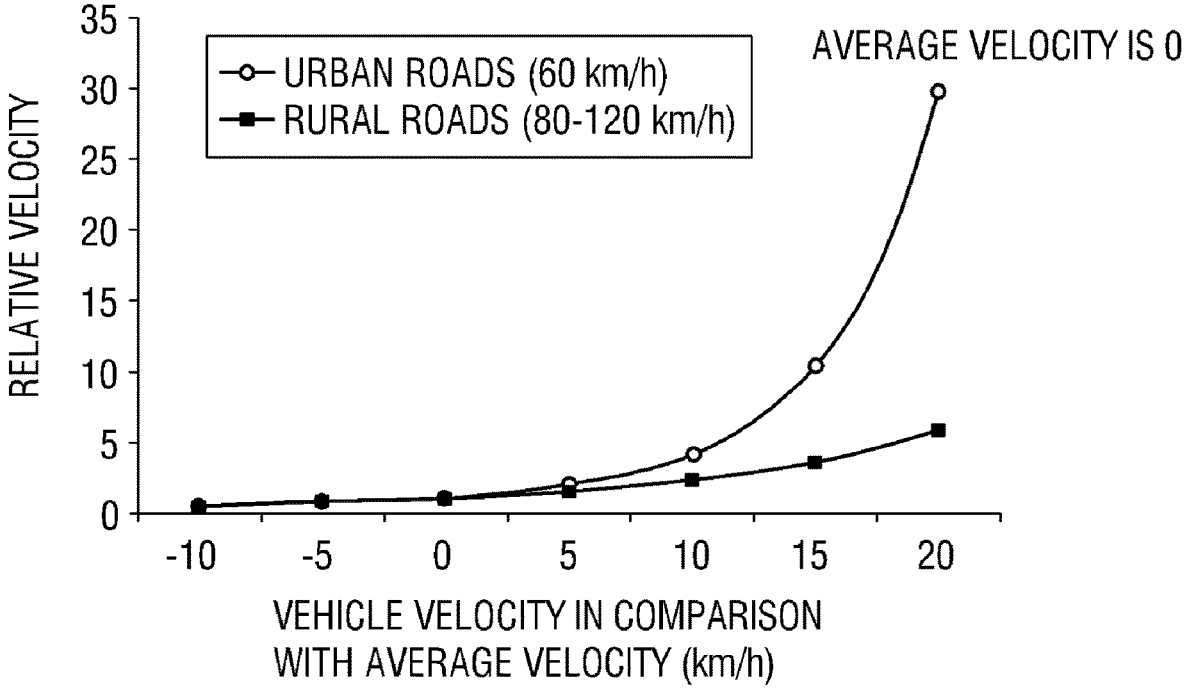

FIGS. 6A and 6B are diagrams explaining the accident rate according to vehicle speed information of the control part.

Referring to FIG. 6A, according to the exemplary embodiment of the present invention, the control part 400 may calculates an accident rate according to vehicle speed information using the relation between an average passage speed and a traffic accident rate.

Referring to FIG. 6B, according to the exemplary embodiment of the present invention, the control part 400 may calculates an accident rate according to vehicle speed information using the relative accident rate for the traffic accident rate in comparison with the average speed.

Figure 7A:
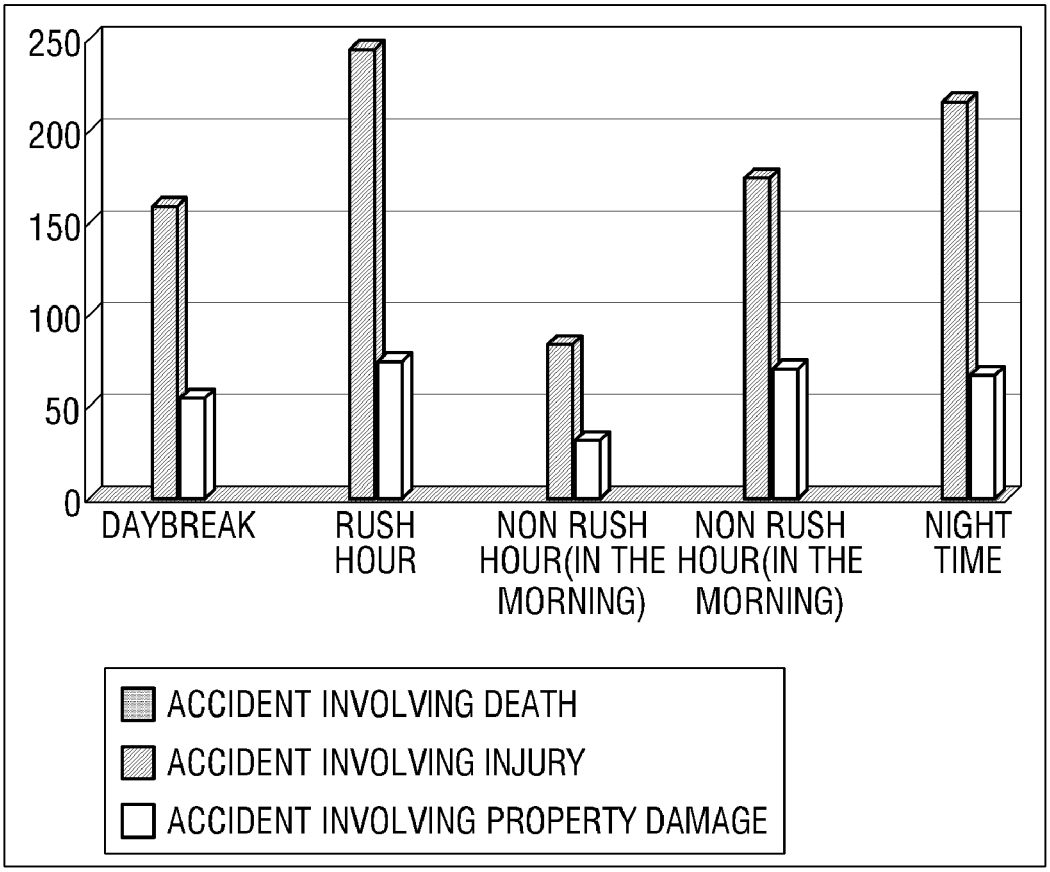
FIGS. 7A and 7B are diagrams explaining an accident rate according to accident history information of the control part according to an exemplary embodiment of the present invention.
Figure 7B:
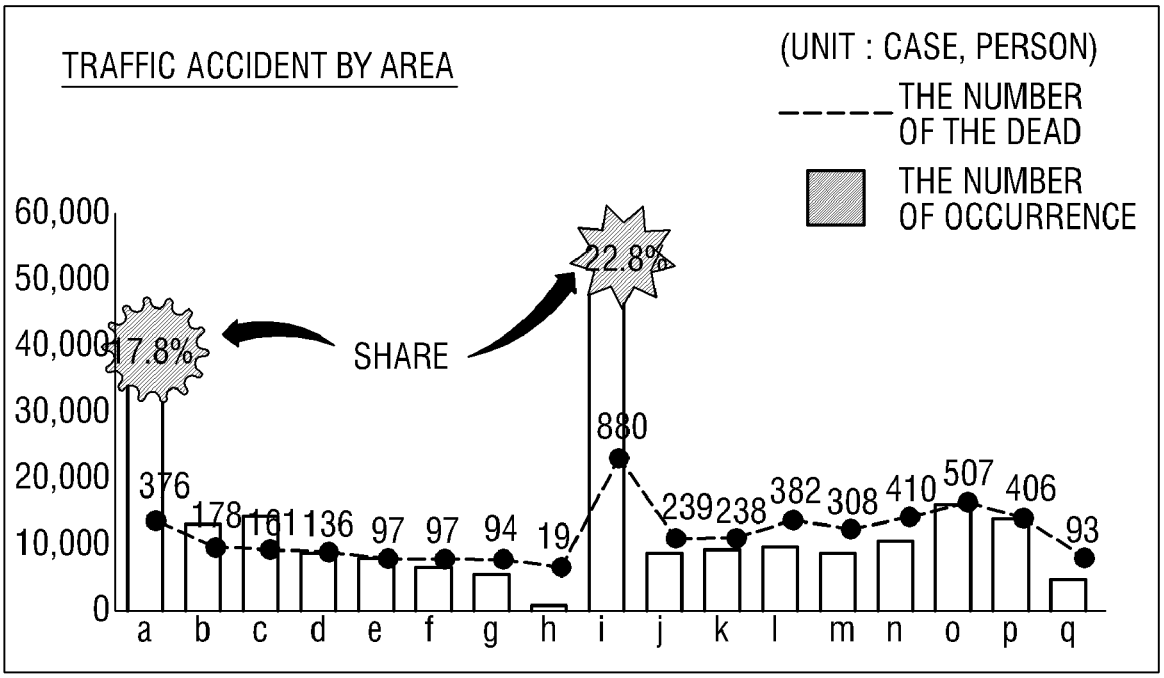
Figure 7B:
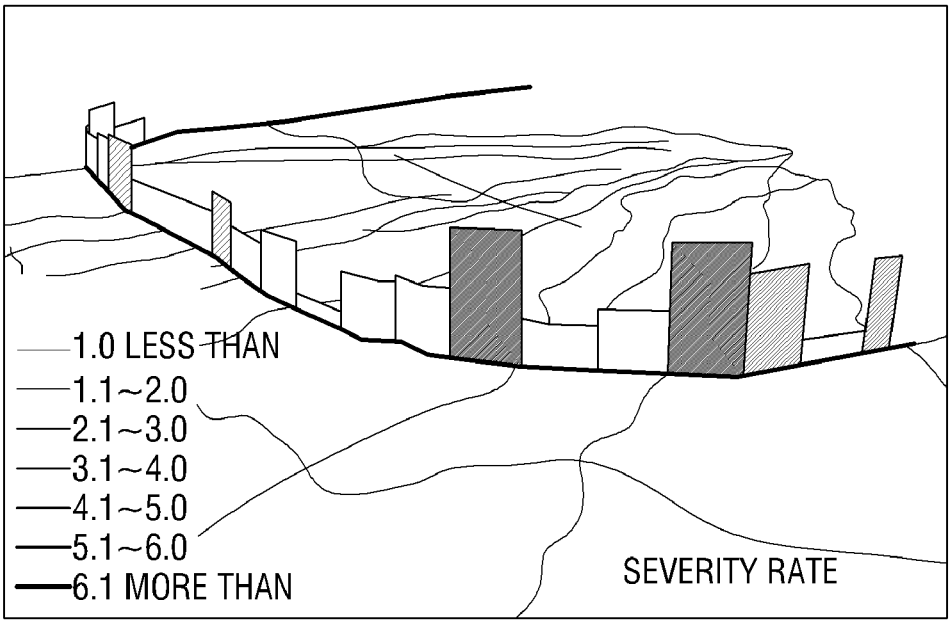

FIGS. 7A and 7B are diagrams explaining the accident rate according to accident history information.

Referring to FIG. 7A, the control part 400 may calculate a traffic accident incidence using information for the traffic accident rate by time, day and month, transferred from the road traffic related organization.

Referring to FIG. 7B, the control part 400 may calculate a traffic accident incidence using information for the traffic accident incidence of the area and the specific road, transferred from the road traffic related organization.

According to the exemplary embodiment of the present invention, the control part 400 may calculate an algorithm of the system of traffic forecasting using the formula 5 through the multivariate analysis using road surface information, weather information, vehicle speed information and accident history information. The multivariate analysis used herein may include discriminant analysis, multiple regression analysis, factor analysis, correlation analysis as well as various kinds of analysis.

According to the exemplary embodiment of the present invention, the control part 400 may calculate the each analysis using formula 5, thereby calculating four algorithms of the system of traffic forecasting.

$$y = \beta_0 + \beta_1 F_1 + \beta_2 F_2 + \ldots + \beta_n F_n, \quad \text{[Formula 5]}$$

where, y is a prediction function, ββ0 is a constant for the accident rate forecasted through each analysis (it is different by analysis), ββ1~ββn are a coefficient of each term of the prediction function (that is, a weight) (wherein, the discriminant analysis uses a canonical correlation coefficient, the multiple regression analysis uses a regression coefficient, the factor analysis uses a factor (variable) coefficient, and the correlation analysis uses a covariance), and F1~Fn are an independent variable used for the prediction function (that is, road surface information, weather information, vehicle speed information and accident history information).

According to the exemplary embodiment of the present invention, the control part 400 may measure explanatory capacities of the four types of analysis calculated by the formula 5 using formula 6 represented as below, thereby calculating, as a traffic accident incidence, the highest explanatory capacity among them.

$$r = \frac{\sum_{i=1}^{n} (Y_i - \bar{Y})(y_i - \bar{y})}{(n-1)sd_Y sd_y} \quad \text{[Formula 6]}$$

where, r is an explanatory capacity, Y is a set of the data for accident rates of the past data (that is, the number of data bases for the accident rate in the accident history information included in the second information), y is a data base of the accident rate calculated by the prediction function (that is, the number of data bases), sd is a deviation for the data base of the accident rate, and n is a dimension of the data base for the past accident rate (that is, the number of the databases).

According to the exemplary embodiment of the present invention, the control part 400, for example, may select the accident rate calculated by the discriminant analysis when the explanatory capacity using the discriminant analysis is the highest among those of the each analysis using formula 6 (that is, a traffic accident incidence).

FIG. 8 is a diagram where a weight is applied to the traffic accident incidence calculated in the control part.

Referring to FIG. 8, the system of traffic forecasting 10 assumes that a vehicle A passes a specific position, wherein the weather condition is that a rainfall is 10 mm, the past accident history is once a year, the road surface is in an icy state, and the vehicle speed is 10 Km/h higher than the road speed limit.

According to the exemplary embodiment of the present invention, the control part 400 may calculate the final danger degree by multiplying danger degrees by weather information, accident history information, road surface information and a vehicle speed by a weight, followed by adding up all together.

According to the exemplary embodiment of the present invention, the control part 400, for example, may calculate the final danger degree as 61/100 by selecting a proper weight for the each information, multiplying the each information by the relevant selected weight and adding up all together. Thus, it may save the relevant final danger degree as a traffic accident incidence.

FIG. 9A to FIG. 9C are diagrams illustrating the traffic accident incidence displayed on the display part and the image according thereto.

Referring to FIG. 9A, the display part 500 may display an image where a child is walking (that is, the first image) when the traffic accident incidence according to the speed of a vehicle passing a school zone is under than the first reference (for example, a traffic accident incidence is 30% or lower). Alternatively, it may display either the traffic accident incidence according to the speed of a vehicle passing the school zone (for example, an accident rate is 30%) or the danger index 'warning' (that is, the first danger index) (See FIG. 9A-(A)).

The display part 500 may display an image (that is, the second image) where a child is astonished when the traffic accident incidence is between the first reference and the predetermined second reference (for example, the traffic accident incidence is lower than 30% to 80%). Alternatively, it may display either the traffic accident incidence (for example, the accident rate is 50%) or the danger index 'caution' (that is, the second danger index) (See FIG. 9A-(B)).

The display part (500) display an image (that is, the third image) where a child falls down and then gets injured when the traffic accident incidence is over the second reference (for example, the traffic accident incidence is 80% or higher). Alternatively, it may display either the traffic accident incidence (for example, the accident rate is 80%) or the danger index 'danger' (that is, the third danger index) (See FIG. 9A-(C)).

Referring to FIG. 9B, the display part 500 may display an image where a child is walking (that is, the first image) when the traffic accident incidence according to the speed of a vehicle passing a silver zone is below than the first reference (for example, the traffic accident incidence is 30% or lower). Alternatively, it may display either the traffic accident incidence according to the speed of a vehicle passing the silver zone (for example, the accident rate is 30%) or the danger index 'warning' (that is, the first danger index) (See FIG. 9B-(A)).

The display part 500 may display an image (that is, the second image) where the elderly is astonished and the falls down when the traffic accident incidence is between the first reference and the predetermined second reference (for example, the traffic accident incidence is lower than 30% to 80%). Alternatively, it may display either the traffic accident incidence (for example, the accident rate is 50%) or the danger index 'caution' (that is, the second danger index) (See FIG. 9B-(B)).

The display part (500) display an image (that is, the third image) where the elderly falls down and then gets injured when the traffic accident incidence is over the second reference (for example, the traffic accident incidence is 80% or higher). Alternatively, it may display either the traffic accident incidence (for example, the accident rate is 80%) or the danger index 'danger' (that is, the third danger index) (See FIG. 9B-(C)).

Referring to FIG. 9C, the display part 500 may display an image where a person carrying a stroller is walking (that is, the first image) when the traffic accident incidence according to the speed of a vehicle passing a danger zone is below than the first reference (for example, the traffic accident incidence is 30% or lower). Alternatively, it may display either the traffic accident incidence according to the speed of a vehicle passing the danger zone (for example, an accident rate is 30%) or the danger index 'warning' (that is, the first danger index) (See FIG. 9C-(A)).

The display part 500 may display an image (that is, the second image) where a person carry a stroller is astonished when the traffic accident incidence is between the first reference and the predetermined second reference (for example, a traffic accident incidence is lower than 30% to 80%). Alternatively, it may display either the traffic accident incidence (for example, an accident rate is 50%) or the danger index 'caution' (that is, the second danger index) (See FIG. 9C-(B)).

The display part (500) display an image (that is, the third image) where a person carrying a stroller falls down and then gets injured when the traffic accident incidence is over the second reference (for example, a traffic accident incidence is 80% or higher). Alternatively, it may display either the traffic accident incidence (for example, an accident rate is 80%) or the danger index 'danger' (that is, the third danger index) (See FIG. 9C-(C)).

As described above, the exemplary embodiment of the present invention may be implemented through not only the above described device and/or operation method but also programs, recording media where the programs are recorded, and etc., and it may be easily implemented by those skilled in the art from the description of the above described exemplary embodiment. Although the present invention has been described in considerable detail with reference to certain embodiments thereof, it will be understood that the embodiments are not intended to limit the present invention. It will be apparent to those skilled in the art that various modifications and variations can be made to the structure of the present invention. In view of the foregoing, it is intended that the present invention cover modifications and variations of this invention provided they fall within the scope of the following claims.

The invention claimed is:

1. A system for traffic forecasting, the system comprising:

a sensor part for sensing at least one first information which is predetermined;

a communication part for receiving a second information from at least one of weather related organizations and road traffic related organizations;

a memory part for saving a plurality of images which are connected with a traffic accident incidence;

a control part for calculating the traffic accident incidence within a specific distance from the system for traffic forecasting using the at least one first information and the second information, and for determining an image corresponding to the traffic accident incidence from the plurality of images; and a display part for displaying the traffic accident incidence and the image determined by the control part, wherein the second information comprises accident history information, weather information, road state information, place information and date information, the plurality of images comprise:

a first image which announces a general state where people are walking, under a predetermined first reference;

a second image which announces a slightly dangerous state where people are astonished or fall down due thereto between the first reference and a predetermined second reference; and a third image which announces a dangerous state where people fall down and then get injured over the second reference, and the control part for calculating an algorithm of the system of traffic forecasting using the formula 5 represented as below through a multivariate analysis:

$$y=\beta_0+\beta_1F_1+\beta_2F_2+\ldots+\beta_nF_n, \quad \text{[Formula 5]}$$

wherein, y is a prediction function, β0 is a constant for an accident rate forecasted through each analysis, β1~βn are a respective coefficient, and F1~Fn are a respective independent variable used for the prediction function.

2. The system for traffic forecasting of the claim 1, wherein the first information includes weather information, road state information and vehicle speed information which are sensed from the sensor part.

3. The system for traffic forecasting of the claim 1, wherein the control part calculates a dew point temperature using a relative humidity included in the first information and an ambient temperature included in the second information, and then calculating the traffic accident incidence using the dew point temperature.

4. The system for traffic forecasting of the claim 3, wherein the dew point temperature is calculated by the formula 1 represented as below:

$$D_p(T, RH) = \frac{\lambda \times \left[\ln\left(\frac{RH}{100}\right) + \frac{\beta \times T}{\lambda + T}\right]}{\beta - \left[\ln\left(\frac{RH}{100}\right) + \frac{\beta \times T}{\lambda + T}\right]}, \quad \text{[Formula 1]}$$

wherein Dp is the dew point temperature, T is the ambient temperature, RH is the relative humidity and β and λ represent, as a Magnus constant, 17.62 and 243.12° C., respectively.

5. The system for traffic forecasting of the claim 1, wherein the communication part shares the traffic accident incidence and the image with peripheral devices.

* * * * *